US011638074B2

(12) United States Patent
Jin et al.

(10) Patent No.: US 11,638,074 B2
(45) Date of Patent: Apr. 25, 2023

(54) SPEAKER DEVICE

(71) Applicant: AAC Microtech (Changzhou) Co., Ltd., Changzhou (CN)

(72) Inventors: Xin Jin, Shenzhen (CN); Zhiwei Zhong, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 0 days.

(21) Appl. No.: 17/536,106

(22) Filed: Nov. 29, 2021

(65) Prior Publication Data

US 2022/0174381 A1 Jun. 2, 2022

(30) Foreign Application Priority Data

Nov. 30, 2020 (CN) ..... 202022829381.8

(51) Int. Cl.
*H04R 1/02* (2006.01)
*H04R 9/02* (2006.01)
*H04R 9/06* (2006.01)

(52) U.S. Cl.
CPC ..... *H04R 1/021* (2013.01); *H04R 9/027* (2013.01); *H04R 9/06* (2013.01); *H04R 2209/027* (2013.01); *H04R 2400/11* (2013.01); *H04R 2499/11* (2013.01)

(58) Field of Classification Search
CPC ..... H04R 9/06; H04R 9/025; H04R 9/027; H04R 1/021; H04R 2209/027
See application file for complete search history.

(56) References Cited

U.S. PATENT DOCUMENTS

2020/0413171 A1* 12/2020 Shen ..... H04R 9/025

FOREIGN PATENT DOCUMENTS

WO WO-2021109189 A1 * 6/2021

* cited by examiner

*Primary Examiner* — Sunita Joshi
(74) *Attorney, Agent, or Firm* — W&G Law Group

(57) ABSTRACT

A speaker device includes a frame, a vibration unit and a magnetic circuit unit. The vibration unit includes a diaphragm fixed to the frame and a voice coil. The magnetic circuit unit includes a yoke and a magnet assembly that is accommodated and fixed in the yoke and is spaced apart from the yoke to form a magnetic gap. The voice coil is inserted in the magnetic gap. The yoke includes a yoke bottom wall, a yoke side wall and flanges. The flange includes a first section and a second section extending from the first section. A side of the first section close to the second section and the second section enclose a fixing step. The second section is fixed to the frame. The speaker device of the present disclosure has better reliability.

9 Claims, 5 Drawing Sheets

SPEAKER DEVICE

TECHNICAL FIELD

The present disclosure relates to the technical field of electro-acoustic conversion, and in particular, to a speaker device.

BACKGROUND

With the advent of the Internet era, the number of mobile terminal devices continues to rise. Mobile phones are undoubtedly the most common and most portable mobile terminal devices. Speaker devices are widely used in mobile terminal devices such as mobile phones for playing music, etc. The vibration unit is an important part of the speaker device, which enables the entire speaker device to vibrate and produce sound.

In the related art, a speaker device includes a frame, a vibration unit fixed to the frame and a magnetic circuit unit configured to drive the vibration unit to vibrate and produce sound. The magnetic circuit unit includes a yoke fixed to the frame and a magnet accommodated in the yoke. The yoke and the frame are fixed by gluing.

However, since the frame of the speaker device is typically made of low-strength plastic, the speaker device is easy to be deformed. In addition, the yoke and the frame are prone to move when they are fixed by gluing, which makes it hard for the accurate positioning of the magnetic circuit unit, thereby leading to low reliability of the speaker device.

Therefore, it is necessary to provide a speaker device to solve the above problems.

SUMMARY

An objective of the present disclosure is to provide a speaker device having high reliability.

An aspect of the present disclosure provides a speaker device. The speaker device includes a frame, a vibration unit fixed to the frame, and a magnetic circuit unit driving the vibration unit to vibrate and produce sound. The vibration unit includes a diaphragm fixed to the frame and a voice coil driving the diaphragm to vibrate. The magnetic circuit unit includes a yoke and a magnet assembly. The magnet assembly is accommodated and fixed in the yoke and is spaced apart from the yoke to form a magnetic gap; and the voice coil is inserted in the magnetic gap. The yoke includes a yoke bottom wall, a yoke side wall having a ring shape and bending and extending from a periphery of the yoke bottom wall toward the diaphragm, and a flange bending and extending from an end of the yoke side wall close to the diaphragm toward the frame. The magnet assembly is fixed to the yoke bottom wall and is spaced apart from the yoke side wall to form the magnetic gap. The flange includes a first section bending and extending from the end of the yoke side wall close to the diaphragm toward the frame, and at least one second section extending from an end of the first section away from the yoke side wall toward the frame. A distance between a side of the first section close to the diaphragm and the diaphragm is smaller than a distance between a side of each of the at least one second section close to the diaphragm and the diaphragm. A side of the first section close to the at least one second section and the at least one second section enclose a fixing step. The at least one second section is fixed to the frame.

As an improvement, the frame is made of a metal material, and a side of the at least one second section close to the frame is in contact with and fixed to the frame by laser spot welding.

As an improvement, the first section and the at least one second section each extend in a direction perpendicular to a vibrating direction of the diaphragm.

As an improvement, the flange is formed by bending and extending from each of two opposite sides of the yoke side wall.

As an improvement, the frame includes a frame body for supporting and fixing the diaphragm, and two notches formed by recessing from two opposite sides of the frame body close to the magnetic circuit unit toward the diaphragm; the two notches are in a one-to-one correspondence with the at least one second section; and the at least one second section is accommodated in the two notches and fixed to the two notches.

As an improvement, the frame has a rectangular shape and includes two long sides that are oppositely arranged and two short sides that are oppositely arranged; the two notches are provided at the two long sides; the vibration unit further includes a holder fixed to a side of the diaphragm close to the magnetic circuit unit, and two auxiliary diaphragm assemblies; the two auxiliary diaphragm assemblies are respectively located at two opposite sides of the frame; the voice coil is fixed to the diaphragm through the holder; and each of the two auxiliary diaphragm assemblies includes an end fixed to a side of a short side of the two short sides away from the diaphragm, and the other end connected to the holder.

As an improvement, the holder includes a holder body having a ring shape and fixed to the diaphragm, a first holder fixing portion extending from an outer periphery of the holder body toward the each of the two auxiliary diaphragm assemblies, and at least one second holder fixing portion extending from an inner periphery of the holder body toward the voice coil; each of the two auxiliary diaphragm assemblies is connected to an end of the first holder fixing portion away from the holder body; and the voice coil is connected to the at least one second holder fixing portion.

As an improvement, the at least one second holder fixing portion includes at least two second holder fixing portions, and adjacent ones of the at least two second holder fixing portions are spaced apart to form a leakage channel.

As an improvement, each of the two auxiliary diaphragm assemblies includes an elastic conductive element fixed to the two short sides, and an auxiliary diaphragm attached to a side of the elastic conductive element away from the diaphragm.

As an improvement, a connecting portion extending along an outer periphery of the voice coil is provided at a side of the elastic conductive element close to the voice coil. The connecting portion is connected to a lead wire of the voice coil.

Compared with the related art, in the speaker device of the present disclosure, the yoke includes a yoke bottom wall, a yoke side wall having a ring shape and bending and extending from a periphery of the yoke bottom wall toward the diaphragm and flanges that respectively bend and extend from ends of the yoke side wall toward the diaphragm to the frame. The magnet assembly is fixed to the yoke bottom wall and is spaced apart from the yoke side wall to form the magnetic gap. The flange includes a first section bending and extending from the end of the yoke side wall close to the diaphragm toward the frame, and a second section extending from an end of the first section away from the yoke side wall to the frame. A distance between a side of the first section toward the diaphragm and the diaphragm is smaller than a distance between a side of the second section close to the diaphragm and the diaphragm. A side of the first section close to the second section and the second section enclose a fixing step. The second section is fixed to the frame. With this structure, the yoke surrounds the voice coil for a complete circle without avoiding, thereby optimizing the performance. The second section is fixed to the frame, which increases the fixing area and improves reliability. The fixing of the second section to the frame realizes height positioning of the magnetic circuit unit, and further realizes accurate assembly and positioning of the magnetic circuit unit and the frame. The fixing step is provided to realize the fixing of the yoke to the frame, which avoids the movement of the frame and the yoke and effectively ensures the stable fixing of the frame and the yoke. The internal space of the magnetic circuit unit is saved, and sufficient vibration space is reserved for the vibration unit. In addition, structural interference is avoided, thereby improving the reliability of the speaker device.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF EMBODIMENTS

The technical solutions in the embodiments of the present disclosure are clearly and completely described below with reference to the drawings in the embodiments of the present disclosure. Apparently, the embodiments described are a part, rather than all of the embodiments of the present disclosure. All other embodiments obtained by those skilled in the art based on the embodiments in the present disclosure without creative efforts should fall within the protection scope of the present disclosure.

Figure 1:
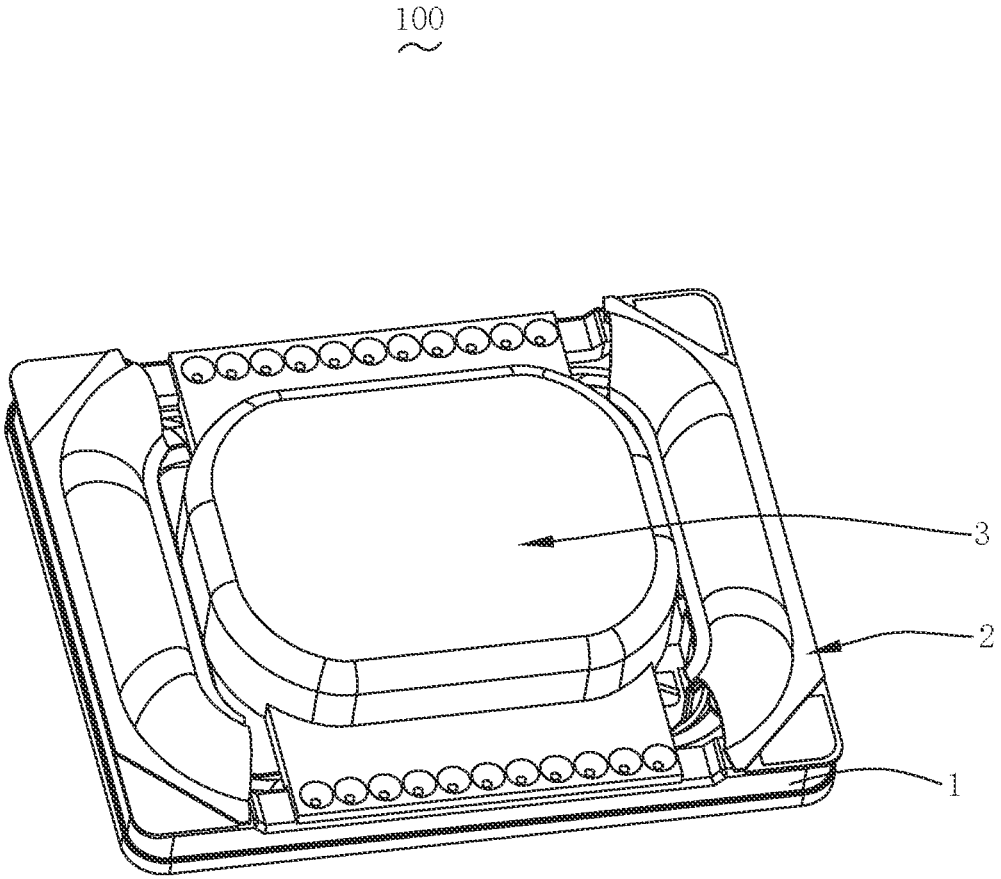
FIG. 1 is a three-dimensional view illustrating a structure of a speaker device according to an embodiment of the present disclosure.
Figure 2:
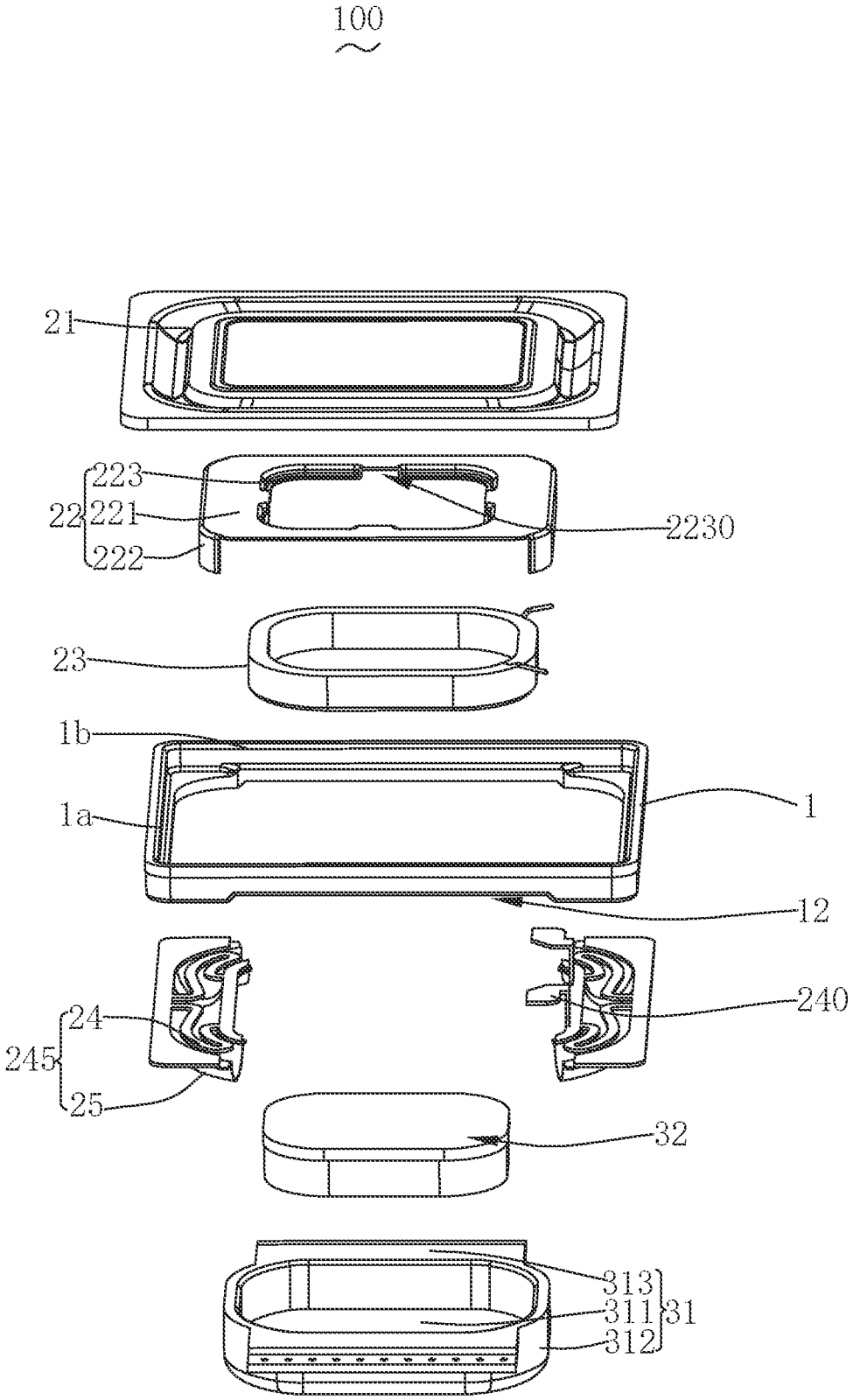
FIG. 2 is a three-dimensional exploded view illustrating a structure of the speaker device according to an embodiment of the present disclosure.
Figure 3:
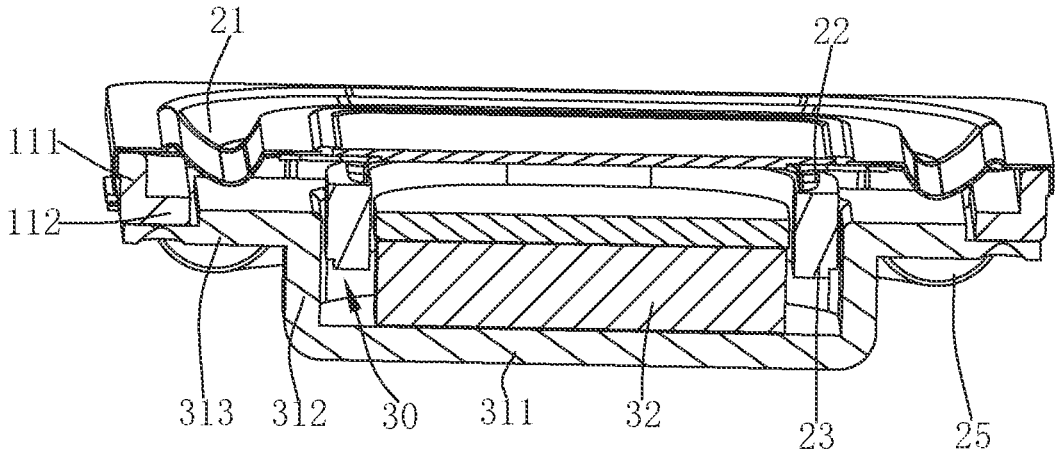
FIG. 3 is a cross-sectional view of the speaker device according to an embodiment of the present disclosure.
Figure 4:
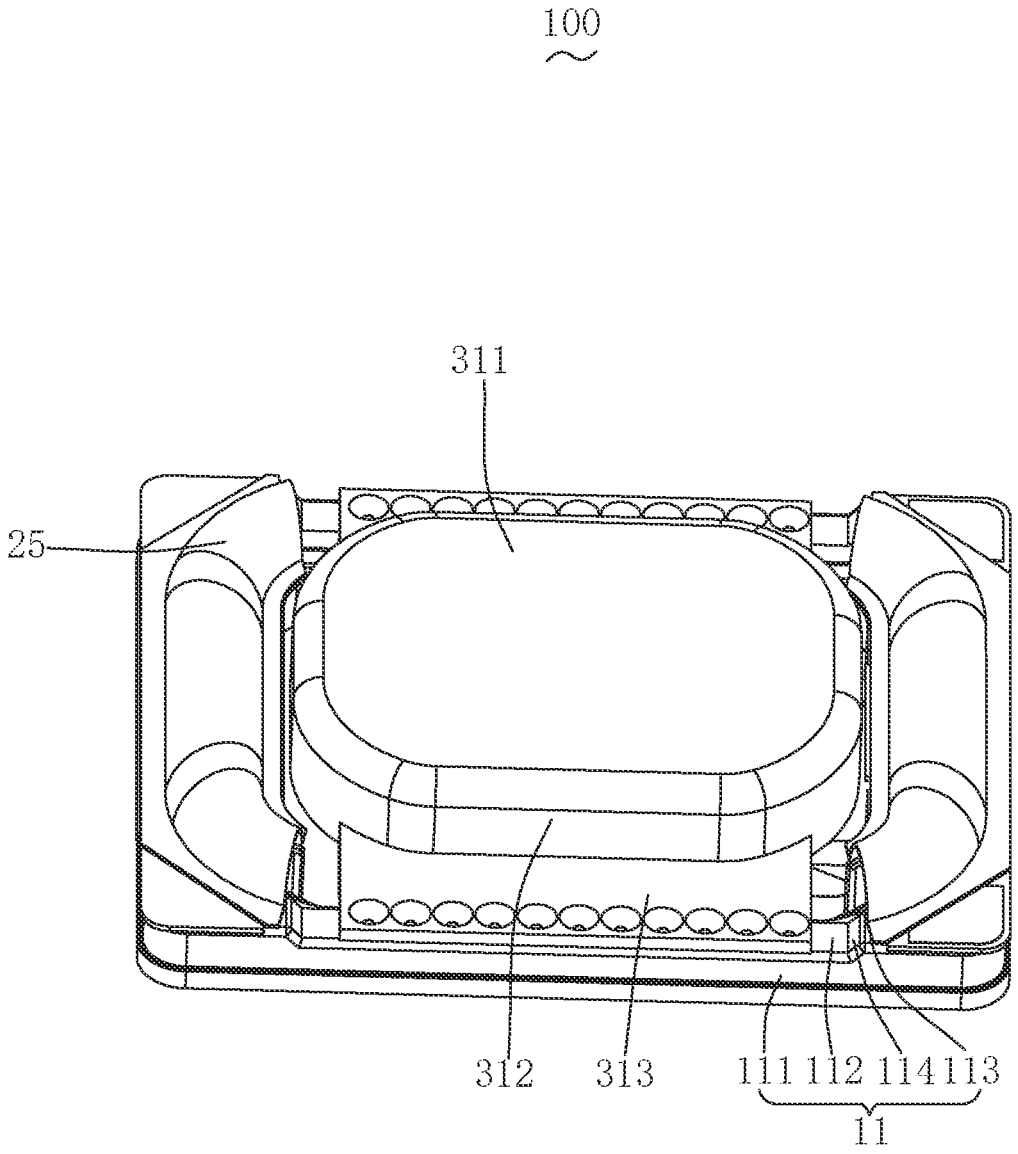
FIG. 4 is a three-dimensional view illustrating a structure of a speaker device from another angle according to an embodiment of the present disclosure.
Figure 5:
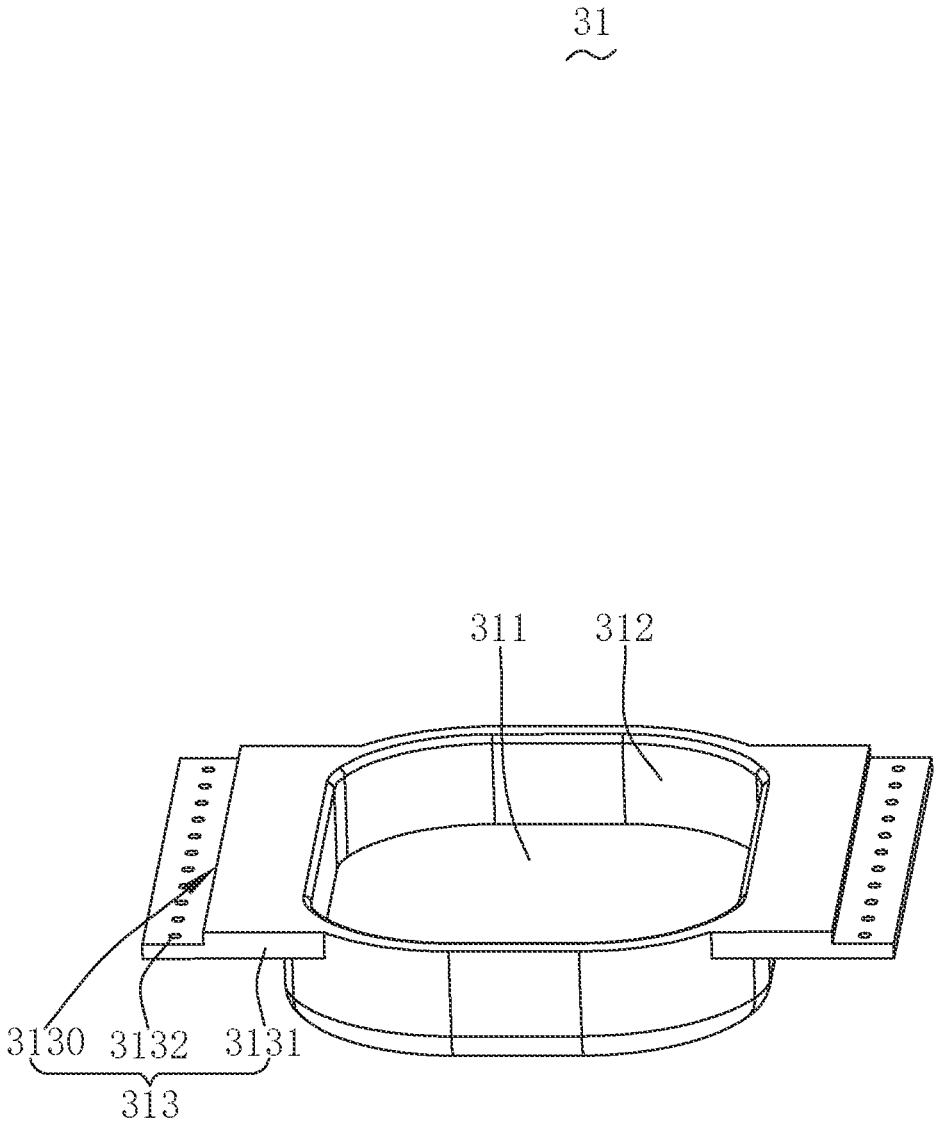
FIG. 5 is a three-dimensional view illustrating a structure of a yoke according to an embodiment of the present disclosure.

Referring to FIG. 1 to FIG. 5, the present disclosure provides a speaker device 100. The speaker device 100 includes a frame 1, a vibration unit 2 fixed to the frame 1 and configured to vibrate and produce sound, and a magnetic circuit 3 for driving the vibration unit 2 to vibrate and produce sound. The vibration unit 2 includes a diaphragm 21 for vibrating and producing sound. The magnetic circuit unit 3 has a magnetic gap 30.

In an embodiment, the frame 1 is made of a metal material. The frame 1 includes a frame body 11 and notches 12. The frame body 11 is configured to support and fix the diaphragm 21. The notches 12 are formed by recessing from two opposite sides of the frame body 11 close to the magnetic circuit unit 3 toward the diaphragm 21. The frame 1 is rectangular, and includes two opposite long sides 1*b* and two opposite short sides 1*a*. The number of the notch 12 is set to be two. The two notches 12 are provided on the two long sides 1*b*, respectively.

In an embodiment, the frame body 11 includes a first side wall 111, a second bottom wall 112, a third bottom wall 113, and fourth inclination walls 114. The first side wall 111 has a ring shape, and forms the notch 12. The second bottom wall 112 is formed by bending and extending from a position of the notch 12 on the first side wall 111 toward a yoke 31. The third bottom wall 113 is formed by bending and extending from an inner side of the first side wall 111 toward the yoke 31. The fourth inclination walls 114 respectively extend from two opposite ends of the second bottom wall 112 to the third bottom wall 113 and is connected to the third bottom wall 113. The second bottom wall 112 and two adjacent fourth inclination walls 114 enclose the notch 12.

In an embodiment, the vibration unit 2 includes the diaphragm 21 fixed to a side of the frame 1 away from the magnetic circuit unit 3, a holder 22 fixed to a side of the diaphragm 21 toward the magnetic circuit unit 3, a voice coil 23 inserted in the magnetic gap 30, and auxiliary diaphragm assemblies 245.

The holder 22 includes a ring-shaped holder body 221 fixed to the diaphragm 21, a first holder fixing portion 222 extending from an outer periphery of the holder body 221 toward the auxiliary diaphragm assembly 245, and at least one second holder fixing portion 223 extending from an inner periphery of the holder body 221 toward the voice coil 23. The auxiliary diaphragm assembly 245 is connected to an end of the first holder fixing portion 222 away from the holder body 221. The voice coil 23 is connected to the second holder fixing portion 223. With this structure, the voice coil 23 drives the diaphragm 21 to vibrate and produce sound through the holder 22, and the auxiliary diaphragm assembly 245 is connected to this structure to improve the balance of vibration and achieve high feasibility.

There are at least two second holder fixing portions 223, and adjacent second holder fixing portions 223 are spaced apart to form a leakage channel 2230. The leakage channel 2230 balances the air pressure inside and outside the voice coil 23, which facilitates the voice coil 23 to drive the diaphragm 21 to vibrate and produce sound, thereby achieving a desirable acoustic effect of the speaker device 100.

There are two auxiliary diaphragm assemblies 245, and the two auxiliary diaphragm assemblies 245 are respectively located at two opposite sides of the frame 1. One end of the auxiliary diaphragm assemblies 245 is fixed to a side of a corresponding short side 1*a* away from the diaphragm 21, and the other end of the auxiliary diaphragm assemblies 245 is connected to the holder 22.

The auxiliary diaphragm assembly 245 includes an elastic conductive element 24 fixed to a side of a short side 1*a* of the frame 1 away from the diaphragm 21, and an auxiliary diaphragm 25 attached to a side of the elastic conductive element 24 away from the diaphragm 21. A connecting portion 240 is provided at a side of the elastic conductive element 24 close to the voice coil 23, and extends along an outer periphery of the voice coil 23. The connecting portion 240 is connected to a lead wire of the voice coil 23. This structure achieves high space utilization.

The magnetic circuit unit 3 includes a yoke 31 and a magnet assembly 32. The magnet assembly 32 is accommodated and fixed in the yoke 31 and is spaced apart from the yoke 31 to form the magnetic gap 30. The yoke 31 includes a yoke bottom wall 311, a yoke side wall 312 having a ring shape and bending and extending from a periphery of the yoke bottom wall 311 toward the diaphragm 21, and a flange 313 that bends and extends from an end of the yoke side wall 312 close to the diaphragm 21 toward the frame 1. The magnet assembly 32 is fixed to the yoke bottom wall 311 and is spaced apart from the yoke side wall 312 to form the magnetic gap 30. An end of the flange 313 away from the yoke side wall 312 is fixed to the frame 1.

In an embodiment, the flange 313 includes a first section 3131 bending and extending from an end of the yoke side wall 312 close to the diaphragm 21 toward the frame 1, and at least one second section 3132 extending from an end of the first section 3131 away from the yoke side wall 312 toward the frame 1. A distance between a side of the first section 3131 close to the diaphragm 21 and the diaphragm 21 is smaller than a distance between a side of the second section 3132 close to the diaphragm 21 and the diaphragm 21. A side of the first section 3131 close to the second section 3132 and the second section 3132 enclose a fixing step 3130. The second section 3132 is fixed to the frame 1.

With this structure, the yoke 31 surrounds the voice coil 23 for a complete circle without avoiding, thereby optimizing the performance. The second section 3132 is fixed to the frame 1, which increases the fixing area and improves reliability. The fixing of the second section 3132 with the frame 1 realizes height positioning of the magnetic circuit unit 3, and then realizes accurate assembly and positioning of the magnetic circuit unit 3 and the frame 1. The fixing step 3130 is provided to realize the fixing of the yoke to the frame 1, which avoids the movement of the frame 1 and the yoke 31 and effectively ensures the stable fixing of the frame 1 and the yoke 31. The internal space of the magnetic circuit unit 3 is saved, and a sufficient vibration space is reserved for the vibration unit 2. In addition, structural interference is avoided, thereby improving the reliability of the speaker device 100.

In an embodiment, the first section 3131 and the second section 3132 extend in a direction perpendicular to the vibrating direction of the diaphragm 21. A side of the second section 3132 close to the frame 1 is in contact with and fixed to the frame 1 by laser spot welding, thereby achieving high reliability and stability. The second section 3132 is welded to the frame 1 with a large thickness, which is hard to break down, and prevents the laser from damaging the diaphragm 21, etc. In addition, the large distance between the frame 1 and the diaphragm 21 provides a large vibration space.

There are two flanges 313 and two second sections 3132. The notches 12 are in a one-to-one correspondence with the second sections 3132. The second sections 3132 are accommodated in the notches 12 and fixed to the notches 12. The second section 3132 is fixed to the second bottom wall 112, such that the height of the entire speaker device 100 along the vibrating direction of the diaphragm 21 is reduced. In this way, the speaker device 100 has a reasonable structural layout. For example, the second section 3132 is accommodated in the notch 12, and the elastic conductive element 24 is fixed to the short side 1*a* of the frame 1, which improves the space utilization.

Compared with the related art, in the speaker device of the present disclosure, the yoke includes a yoke bottom wall, a yoke side wall having a ring shape and bending and extending from a periphery of the yoke bottom wall toward the diaphragm and flanges that respectively bend and extend from ends of the yoke side wall toward the diaphragm to the frame. The magnet assembly is fixed to the yoke bottom wall and is spaced apart from the yoke side wall to form the magnetic gap. The flange includes a first section bending and extending from the end of the yoke side wall close to the diaphragm toward the frame, and a second section extending from an end of the first section away from the yoke side wall to the frame. A distance between a side of the first section close to the diaphragm and the diaphragm is smaller than a distance between a side of the second section close to the diaphragm and the diaphragm. A side of the first section close to the second section and the second section enclose a fixing step. The second section is fixed to the frame. With this structure, the yoke surrounds the voice coil for a complete circle without avoiding, thereby optimizing the performance. The second section is fixed to the frame, which increases the fixing area and improves reliability. The fixing of the second section to the frame realizes height positioning of the magnetic circuit unit, and further realizes accurate assembly and positioning of the magnetic circuit unit and the frame. The fixing step is provided to realize the fixing of the yoke to the frame, which avoids the movement of the frame and the yoke and effectively ensures the stable fixing of the frame and the yoke. The internal space of the magnetic circuit unit is saved, and sufficient vibration space is reserved for the vibration unit. In addition, structural interference is avoided, thereby improving the reliability of the speaker device.

The above are merely some embodiments of the present disclosure. It should be noted that for those skilled in the art, modifications can be made without departing from the inventive concept of the present disclosure, but these all fall into the protection scope of the present disclosure.

What is claimed is:

1. A speaker device, comprising: a frame, a vibration unit fixed to the frame, and a magnetic circuit unit driving the vibration unit to vibrate and produce sound, wherein the vibration unit comprises a diaphragm fixed to the frame and a voice coil driving the diaphragm to vibrate; the magnetic circuit unit comprises a yoke and a magnet assembly, the magnet assembly is accommodated and fixed in the yoke and is spaced apart from the yoke to form a magnetic gap; and the voice coil is inserted in the magnetic gap;

the yoke comprises a yoke bottom wall, a yoke side wall having a ring shape and bending and extending from a periphery of the yoke bottom wall toward the diaphragm, and a flange bending and extending from an end of the yoke side wall close to the diaphragm toward the frame; and the magnet assembly is fixed to the yoke bottom wall and is spaced apart from the yoke side wall to form the magnetic gap; and the flange comprises a first section bending and extending from the end of the yoke side wall close to the diaphragm toward the frame, and at least one second section extending from an end of the first section away from the yoke side wall toward the frame; a distance between a side of the first section close to the diaphragm and the diaphragm is smaller than a distance between a side of each of the at least one second section close to the diaphragm and the diaphragm; a side of the first section close to the at least one second section and the at least one second section enclose a fixing step; and the at least one second section is fixed to the frame;

wherein the frame is made of a metal material, and a side of the at least one second section close to the frame is in contact with and fixed to the frame by laser spot welding.

2. The speaker device as described in claim 1, wherein the first section and the at least one second section each extend in a direction perpendicular to a vibrating direction of the diaphragm.

3. The speaker device as described in claim 1, wherein the flange is formed by bending and extending from each of two opposite sides of the yoke side wall.

4. The speaker device as described in claim 3, wherein the frame comprises a frame body for supporting and fixing the diaphragm, and two notches formed by recessing from two opposite sides of the frame body close to the magnetic circuit unit toward the diaphragm; the two notches are in a one-to-one correspondence with the at least one second section; and the at least one second section is accommodated in the two notches and fixed to the two notches.

5. The speaker device as described in claim 4, wherein the frame has a rectangular shape and comprises two long sides that are oppositely arranged and two short sides that are oppositely arranged; the two notches are provided at the two long sides; the vibration unit further comprises a holder fixed to a side of the diaphragm close to the magnetic circuit unit, and two auxiliary diaphragm assemblies; the two auxiliary diaphragm assemblies are respectively located at two opposite sides of the frame; the voice coil is fixed to the diaphragm through the holder; and each of the two auxiliary diaphragm assemblies comprises an end fixed to a side of a short side of the two short sides away from the diaphragm, and the other end connected to the holder.

6. The speaker device as described in claim 5, wherein the holder comprises a holder body having a ring shape and fixed to the diaphragm, a first holder fixing portion extending from an outer periphery of the holder body toward the each of the two auxiliary diaphragm assemblies, and at least one second holder fixing portion extending from an inner periphery of the holder body toward the voice coil; each of the two auxiliary diaphragm assemblies is connected to an end of the first holder fixing portion away from the holder body; and the voice coil is connected to the at least one second holder fixing portion.

7. The speaker device as described in claim 6, wherein the at least one second holder fixing portion comprises at least two second holder fixing portions, and adjacent ones of the at least two second holder fixing portions are spaced apart to form a leakage channel.

8. The speaker device as described in claim 5, wherein each of the two auxiliary diaphragm assemblies comprises an elastic conductive element fixed to the two short sides, and an auxiliary diaphragm attached to a side of the elastic conductive element away from the diaphragm.

9. The speaker device as described in claim 8, wherein a connecting portion extending along an outer periphery of the voice coil is provided at a side of the elastic conductive element close to the voice coil, and the connecting portion is connected to a lead wire of the voice coil.

* * * * *